US009664418B2

(12) United States Patent
Nemit, Jr.

(10) Patent No.: US 9,664,418 B2
(45) Date of Patent: May 30, 2017

(54) VARIABLE VOLUME SCREW COMPRESSORS USING PROPORTIONAL VALVE CONTROL

(71) Applicant: JOHNSON CONTROLS TECHNOLOGY COMPANY, Holland, MI (US)

(72) Inventor: Paul Nemit, Jr., Greencastle, PA (US)

(73) Assignee: Johnson Controls Technology Company, Holland, MI (US)

( * ) Notice: Subject to any disclaimer, the term of this patent is extended or adjusted under 35 U.S.C. 154(b) by 222 days.

(21) Appl. No.: 14/197,395

(22) Filed: Mar. 5, 2014

(65) Prior Publication Data

US 2014/0260414 A1 Sep. 18, 2014

Related U.S. Application Data

(60) Provisional application No. 61/783,948, filed on Mar. 14, 2013.

(51) Int. Cl.

| | |
|---|---|
| ***F25B 1/047*** | (2006.01) |
| ***F04C 18/16*** | (2006.01) |
| ***F04C 28/12*** | (2006.01) |

(52) U.S. Cl.

CPC ..... *F25B 1/047* (2013.01); *F04C 18/16* (2013.01); *F04C 28/12* (2013.01)

(58) Field of Classification Search

CPC ..... F04C 18/16; F04C 28/12; F25B 1/047

See application file for complete search history.

(56) References Cited

U.S. PATENT DOCUMENTS

| | | | | |
|---|---|---|---|---|
| 3,432,089 | A * | 3/1969 | Schibbye | F01C 20/12 417/310 |
| 3,936,239 | A | 2/1976 | Shaw | |
| 4,609,329 | A * | 9/1986 | Pillis | F04C 28/125 417/282 |
| 4,678,406 | A | 7/1987 | Pillis et al. | |
| 4,877,380 | A | 10/1989 | Glanvall | |
| 5,135,374 | A | 8/1992 | Yoshimura et al. | |
| 5,207,568 | A | 5/1993 | Szymaszek | |

(Continued)

FOREIGN PATENT DOCUMENTS

| | | |
|---|---|---|
| WO | 2010008457 A2 | 1/2010 |
| WO | 2012037229 A1 | 3/2012 |
| WO | 2012039928 A2 | 3/2012 |

*Primary Examiner* — Emmanuel Duke

(74) *Attorney, Agent, or Firm* — Fletcher Yoder, P.C.

(57) ABSTRACT

A variable-efficiency screw compressor for use in a closed-loop system configured to perform refrigeration is provided. The variable-efficiency screw compressor includes an inlet port to draw refrigerant into the variable-efficiency screw compressor, one or more rotating screws in fluid communication with the inlet port to compress the refrigerant, forming a compressed refrigerant, a discharge port in fluid communication with the rotating screws to receive the compressed refrigerant and discharge the refrigerant, wherein the discharge port includes an adjustable piston movable within the discharge port from a first position in which volume is higher to a second position in which volume is lower, the adjustable piston arranged and disposed to adjust volume of the discharge port in response to a change in demand.

15 Claims, 6 Drawing Sheets

(56) References Cited

U.S. PATENT DOCUMENTS

| | | | | |
|---|---|---|---|---|
| 5,979,168 | A * | 11/1999 | Beekman | F04C 28/12 417/310 |
| 6,050,797 | A | 4/2000 | Zhong | |
| 6,055,797 | A | 5/2000 | Nagashima | |
| 6,059,551 | A | 5/2000 | Amano et al. | |
| 6,093,007 | A | 7/2000 | Shaw | |
| 6,186,758 | B1 | 2/2001 | Shaw | |
| 6,506,031 | B2 | 1/2003 | Sishtla | |
| 6,551,084 | B2 | 4/2003 | Sundstrom | |
| 6,820,434 | B1 | 11/2004 | Gutheim et al. | |
| 6,883,341 | B1 | 4/2005 | Lifson | |
| 6,973,797 | B2 | 12/2005 | Nemit, Jr. | |
| 7,347,301 | B2 | 3/2008 | Sekiya et al. | |
| 7,854,596 | B2 | 12/2010 | Schnetzka et al. | |
| 8,641,395 | B2 | 2/2014 | Nemit, Jr. | |
| 2008/0260539 | A1 | 10/2008 | Stinessen et al. | |
| 2012/0227437 | A1* | 9/2012 | Nemit, Jr. | F04C 28/12 62/498 |
| 2012/0282129 | A1* | 11/2012 | Nemit, Jr. | F04C 18/16 418/201.1 |

* cited by examiner

VARIABLE VOLUME SCREW COMPRESSORS USING PROPORTIONAL VALVE CONTROL

FIELD OF THE INVENTION

The application generally relates to variable capacity screw compressors and systems having variable capacity screw compressors and more specifically to infinitely variable capacity screw compressors.

BACKGROUND OF THE INVENTION

In positive-displacement compressors, capacity control may be obtained by both speed modulation and suction throttling to reduce the volume of vapor or gas drawn into a compressor. Positive displacement compressors include, for example, reciprocating compressors, rotary compressors, scroll compressors and screw compressors. Screw compressors, also known as helical lobe rotary compressors, are well-known in the air compressor refrigeration, water chiller and natural gas processing industries.

Reciprocating compressors utilize a movable piston in a cylinder. The piston is attached to a connecting rod which is attached to a crank. An electric motor drives the crank which causes the piston to reciprocate within the cylinder, increasing and decreasing the volume within the cylinder. Fluid is introduced into the cylinder through a valve when the piston is at the top of its stroke. The fluid is compressed and removed from the cylinder through a valve when the piston is at the bottom of the its stroke.

Scroll compressors generate a series of crescent-shaped pockets between two scrolls, the crescent-shaped pockets receiving fluid for compression. Typically, one scroll is fixed and the other orbits around the fixed scroll. As the motion occurs, the pockets between the two forms are slowly pushed to the center of the two scrolls. This reduces the fluid volume.

Rotary compressors are of two general types: stationary blade and rotating blade compressors. The blades or vanes on a rotating blade rotary compressor rotate with the shaft within a cylindrical housing. In a stationary blade compressor, the stationary blade has a blade that remains stationary and is part of the housing assembly, while a cylinder rotates within the housing assembly, via a roller on an eccentric shaft within the cylinder. In both types, the blade provides a continuous seal for the fluid. Low pressure fluid from a suction line is drawn into an opening. The fluid fills the space behind the blade as it revolves. The trapped fluid in the vapor space ahead of the blade is compressed until it can be pushed into the compressor exhaust.

Screw compressors generally include two cylindrical rotors mounted on separate shafts inside a hollow, double-barreled casing. The side walls of the compressor casing typically form two parallel, overlapping cylinders which house the rotors side-by-side, with their shafts parallel to the ground. Screw compressor rotors typically have helically extending lobes and grooves on their outer surfaces forming a large thread on the circumference of the rotor. During operation, the threads of the rotors mesh together, with the lobes on one rotor meshing with the corresponding grooves on the other rotor to form a series of gaps between the rotors. These gaps form a continuous compression chamber that communicates with the compressor inlet opening, or "port," at one end of the casing and continuously reduces in volume as the rotors turn and compress the gas toward a discharge port at the opposite end of the casing.

Common to each type of compressor is an inlet, an outlet and a working chamber. A compressor inlet is sometimes also referred to as the "suction" or "low pressure side," while the discharge is referred to as the "outlet" or "high pressure side." Refrigerant gas, after passing through the inlet, is compressed to a higher pressure in the working chamber. A mechanical means acts on the refrigerant gas to compress it from a first pressure to a second chamber. The mechanical means for compressing the refrigerant gas differs among the various positive displacement compressors. The compressed refrigerant gas then passes from the compressor through an outlet or discharge port to the remainder of the refrigeration system.

Screw compressor rotors intermesh with one another and rotate in opposite directions in synchronization within a housing. The rotors operate to sweep a gas through the housing from an intake manifold at one end of the housing to an output manifold at the other end of the housing. Commercially available screw compressors most commonly include threaded shafts or helical rotors having four lobes, however, others have been designed to have five or more lobes; however, it may be possible to use rotors having 2-5 lobes. The rotor shafts are typically supported at the end walls of the casing by lubricated bearings.

Capacity control for such compressors can provide continuous modulation from 100% capacity to less than 10% capacity, good part-load efficiency, unloaded starting, and unchanged reliability. In a refrigeration system, capacity also can be regulated based upon a temperature set point for the space being cooled. In other systems where the compressor is processing gas, capacity may be regulated to fully load the torque generator or prime mover (turbine or engine drive) for the compressor. However, all of the currently available methods are expensive and add to the initial cost of investment in the equipment.

In chiller applications where economy is desired both in the initial cost of the system and in operation of the system, a variable volume ratio application is desired. In a screw compressor, the volume, or compression ratio Vi, is the ratio of the volume of a groove at the start of compression to the volume of the same groove when the discharge port begins to open. Hence, the volume ratio in a screw compressor is determined by the size and shape of the discharge port.

For maximum efficiency, the pressure generated within the grooves during compression should exactly equal the pressure in the discharge line when the volume begins to open to it. If this is not the case, either over-compression or under-compression occurs, both resulting in internal losses in efficiency. Such losses in efficiency increase power consumption and/or noise, while reducing efficiency.

If the operating conditions of the system seldom change, it is possible to specify a fixed-volume ratio compressor that will provide good efficiency. But since over-compression can cause damage to a compressor, compressors are designed to limit over-compression, so they do not frequently operate in an over-compression mode. Compressors designed to limit over-compression are often designed to run at a maximum or substantially maximum compression under the most severe operating conditions. When not under the most severe operating conditions, the fixed-volume ratio compressor designed to limit over-compression will run in under-compression mode, which results in at least reduced efficiency.

What is needed is a system that permits adjustments to the volume ratio depending on the conditions that the compressor experiences. This will allow the compressor discharge volume to be adjusted to change the discharge volume, and hence the volume ratio, as operating conditions change resulting in a change in refrigeration demand, allowing the compressor to operate at increased an improved efficiency.

SUMMARY OF THE INVENTION

The present invention is directed to a positive displacement, variable efficiency compressor in which the volume of the discharge port includes means for adjusting the discharge port volume in response to a change in demand so that the compressor can operate at or near maximum efficiency in response to demand.

In an exemplary embodiment, a variable-efficiency screw compressor includes an inlet port to draw refrigerant into the variable-efficiency screw compressor, at least one rotating screw, in fluid communication with the inlet port to compress the refrigerant, forming a compressed refrigerant gas, a discharge port having a volume in fluid communication with the rotating screws to receive the compressed refrigerant gas and discharge the compressed refrigerant gas, wherein the discharge port includes an adjustable piston movable within the discharge port from a first position in which volume is higher to a second position in which volume is reduced or lowered, the adjustable piston arranged and disposed to adjust volume of the discharge port in response to a change in demand. Screw compressors may include a plurality of rotating screws synchronized to rotate together.

In another exemplary embodiment, a variable-efficiency refrigeration system includes a compressor that compresses a refrigerant gas, to produce a compressed refrigerant gas, a power source powering the compressor, a control panel modulating the power source, a condenser in fluid communication with the compressor that condenses the compressed refrigerant gas to a high pressure compressed liquid, an evaporator in fluid communication with the condenser and with the compressor, an expansion valve positioned between the condenser and the evaporator, wherein the expansion valve receives condensed, high pressure refrigerant liquid and expands the condensed refrigerant, reducing the pressure, to form a mist of gas and liquid for the evaporator, and wherein the compressor is a variable-efficiency screw compressor. The variable-efficiency screw compressor further includes an inlet port to draw refrigerant gas into the variable-efficiency screw compressor, one or more rotating screws in fluid communication with the inlet port to compress the refrigerant, forming a compressed refrigerant, a discharge port in fluid communication with the rotating screws to receive the compressed refrigerant gas and discharge the compressed refrigerant gas, wherein the discharge port includes an adjustable piston movable within the discharge port from a first position in which volume is higher, to a second position in which volume is lower, the and to any intermediate position between the first position and the second position, the adjustable piston arranged and disposed to adjust volume of the discharge port in response to a change in demand.

In another exemplary embodiment, a variable-efficiency screw compressor system includes an inlet port to draw refrigerant into the variable-efficiency screw compressor, one or more rotating screws in fluid communication with the inlet port to compress the refrigerant, compressing the refrigerant gas, a discharge port in fluid communication with the rotating screws to receive the compressed refrigerant gas and discharge the refrigerant, wherein the discharge port includes an adjustable piston movable from a first position that provides the discharge port with a maximum volume and a second position providing the discharge port with a minimum volume, and to any intermediate position between the first position and the second position, the intermediate position providing an intermediate volume in response to a change in demand.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
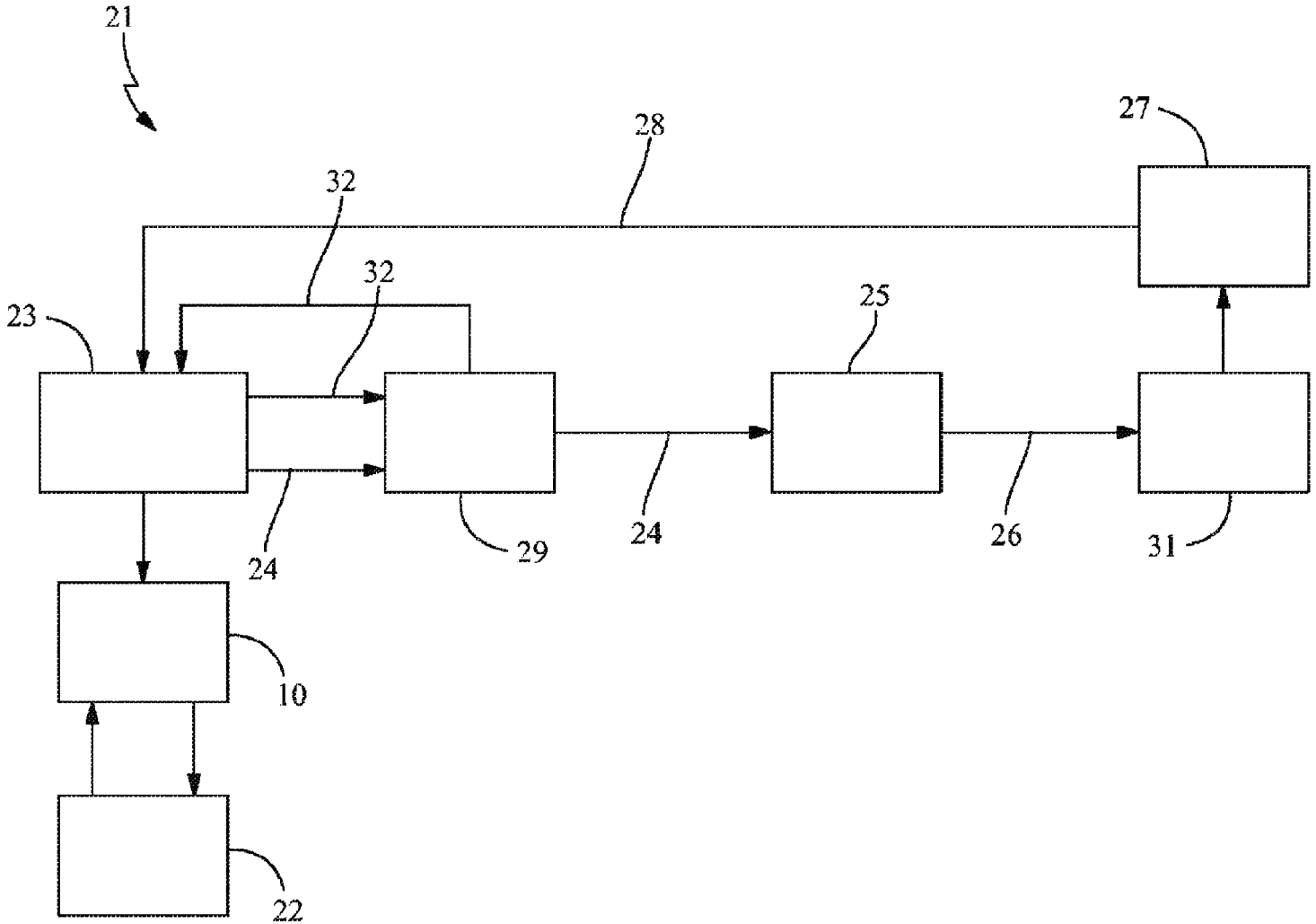
FIG. 1 Prior Art
FIG. 1 schematically depicts a closed loop system for refrigeration.
Figure 2:
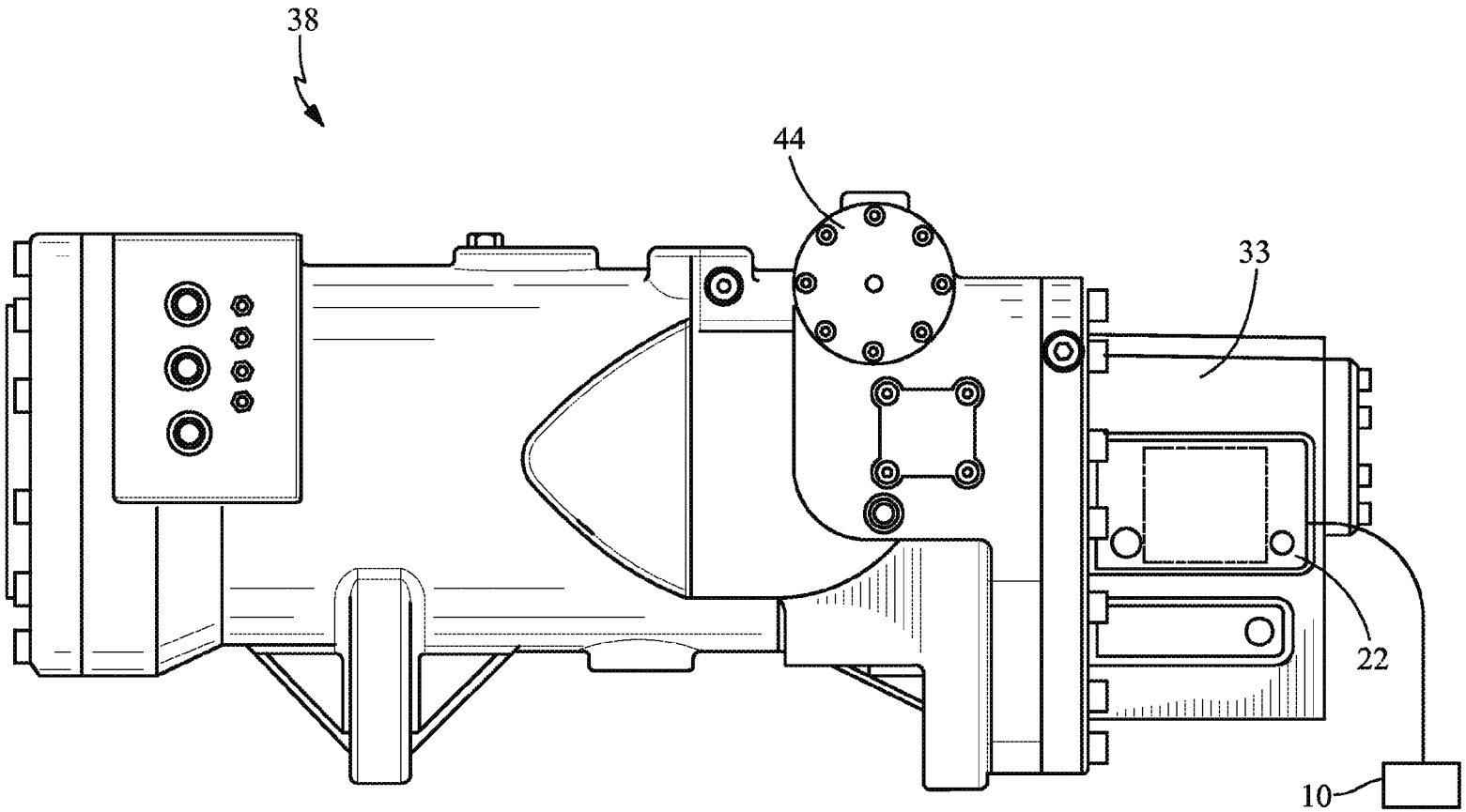
FIG. 2 Prior Art
FIG. 2 schematically illustrates a screw compressor configured for use as the closed loop system of FIG. 1.

Referring to FIG. 1 and FIG. 2, a schematic for a closed loop refrigeration system (refrigeration system) 21 is shown. Refrigeration system 21 includes refrigerant 28 as the working fluid. Refrigerant 28 is compressed by a compressor 23, such as a screw compressor 38, forming a compressed refrigerant gas 24. Compressor 23 is powered by a power source 10, and power source 10 is modulated by a control panel 22. Compressed refrigerant gas 24 from compressor 23 is discharged through a discharge port 48 (FIG. 3) which is in fluid communication with a condenser 25. Condenser 25 condenses compressed refrigerant gas 24 into a liquid refrigerant 26. Condenser 25 is a heat exchanger that provides heat exchange communication of the refrigerant with a heat transfer medium that removes heat of condensation resulting from compressed refrigerant gas 24 undergoing a change of state as it is condensed into liquid refrigerant 26. This heat transfer medium includes, but is not limited to, atmospheric air (air or forced air), a liquid (preferably water), or a combination thereof. Liquid refrigerant 26 is in fluid communication with an expansion valve 31 that expands at least a portion of liquid refrigerant 26 into refrigerant 28 as it flows to an evaporator 27. The refrigeration system 21 from discharge port 48 of compressor 23 to expansion valve 31 is termed the high-pressure side of refrigeration system 21.

Expansion valve 31 decreases the pressure of liquid refrigerant 26 having a higher pressure, converting it into a mist of gas and liquid droplets having a lower pressure as the gas traverses it, while evaporator 27 receives the mist from expansion valve 31. Evaporator 27 is in heat exchange communication with a heat transfer medium. Heat is absorbed from the heat transfer medium as refrigerant mist changes state to refrigerant gas in evaporator 27, cooling the heat transfer medium. The cooled heat transfer medium may be used directly to cool or refrigerate an area, for example, when the heat transfer medium is air circulating from the area to be cooled passing over the evaporator. Alternatively, the heat transfer medium may be liquid, such as water in heat exchange relationship with the evaporator that is sent to a chiller. Refrigerant 28 from the evaporator, now a low pressure gas, is then returned to an inlet port 44 on a suction side of compressor 23 to complete the closed loop of refrigeration system 21. The refrigeration system 21 immediately after expansion valve 31 to the suction side of compressor 23 is termed the low-pressure side of refrigeration system 21.

Figure 3:
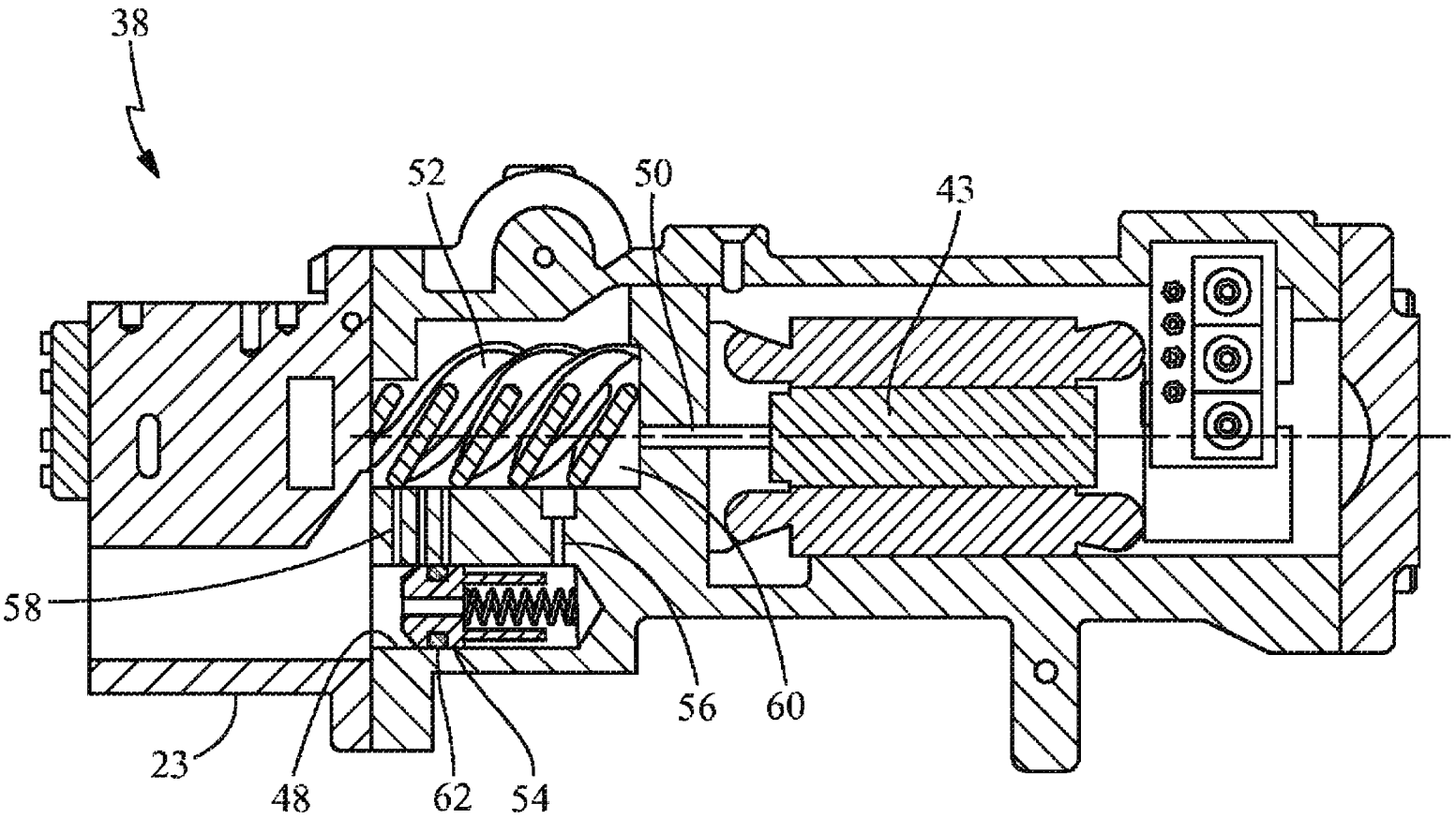
FIG. 3 depicts a section view of the screw compressor of FIG. 2 showing the interior components of the screw compressor through the housing, the view further showing the discharge port with a piston in the discharge port.

Referring to FIG. 2 and FIG. 3, in one embodiment, positive displacement compressor 23 in refrigeration system 21 of FIG. 1 may be a screw compressor 38. FIG. 3 depicts, in cross-section through a compressor housing, some of the interior components of screw compressor 38. The compressor housing encloses one or more rotating screws 52 of screw compressor working within an operating chamber. Operating chamber varies in length based on a position of rotating screws 52. Operating chamber has an increased length when rotating screws 52 are not aligned with one another. Operating chamber has a decreased length when the rotating screws 52 are in meshing alignment with one another. Screw compressor 38 includes control panel 22 connected to power source 10, which powers a motor 43 that drives one or more rotating screws 52. Rotating screws 52 include helical-grooves, each groove decreasing in volume between inlet port 44 and discharge port 48. The decreasing volume of the helical-grooves across the compressor compresses refrigerant gas 28 entering screw compressor 38 through inlet port 44, providing high pressure compressed refrigerant gas 24 at discharge port 48.

In one embodiment, screw compressor 38 includes a lubrication system as is known in the art. Lubrication systems include lubricating oil 32 (usually specially formulated mineral oils which are completely dehydrated, wax-free and non-foaming), an oil pump to deliver oil under pressure to all bearing surfaces, and an oil separator 29, which is an optional component in FIG. 1, being present when compressor 23 is a screw compressor 38. Lubricating oil 32 is separated from compressed refrigerant gas 24 exiting screw compressor 38. Lubricating oil 32 is then returned to the low pressure side of screw compressor 38 to seal a clearance between rotating screws 52, and between rotating screws 52 and a cylinder.

Screw compressor 38 is in fluid communication with oil separator 29. Low pressure refrigerant 28 from evaporator 27 and lubricating oil 32 are introduced into the suction side of screw compressor 38 at inlet port 44 to lubricate rotating screws 52 of screw compressor 38. Once compressed within screw compressor 38, the mixture of compressed refrigerant gas 24 and lubricating oil 32 is discharged from discharge port 48 of screw compressor into oil separator 29 where a mist of lubricating oil 32 in the form of finely divided particles entrained in compressed refrigerant gas 24 is separated from compressed refrigerant gas 24. Oil separator is maintained at or near the gas pressure of the compressor discharge. After separation, compressed refrigerant gas 24 exits oil separator 29 and is provided to condenser 25 in refrigeration system 21. The exit of oil separator 29 may also be termed the oil separator discharge port. For simplicity, it shall be referred to herein as the exit of oil separator 29 or oil separator exit.

Referring to FIG. 3, in one embodiment, the internal mechanisms of screw compressor 38 can be seen. A shaft 50 extending from motor 43 is connected to at least one rotating screw 52 of a pair of screws 52. One rotating screw 52 of the pair of screws 52 may be stationary, or both screws 52 of the pair may rotate, driven by the use of rotor-synchronized timing gears that synchronize rotating screw 52 rotation. Refrigerant 28 enters screw compressor 38 through inlet port 44 and is compressed within the helical-grooves of screws 52. Compressed refrigerant gas 24 is discharged into discharge port 48, which is in fluid communication with downstream condenser 25 and optional oil separator 29 in refrigeration system 21. As seen in FIG. 3, a piston 54 is positioned within discharge port 48. Piston 54 is urged to move by pressure fed through a proportional valve 56 coupled to discharge port 48. The pressure through proportional valve is balanced by a biasing means. The position of piston 54 within discharge port 48 covers or uncovers by-pass holes 58 between a rotor bore 60 and discharge port 48.

Figure 4:
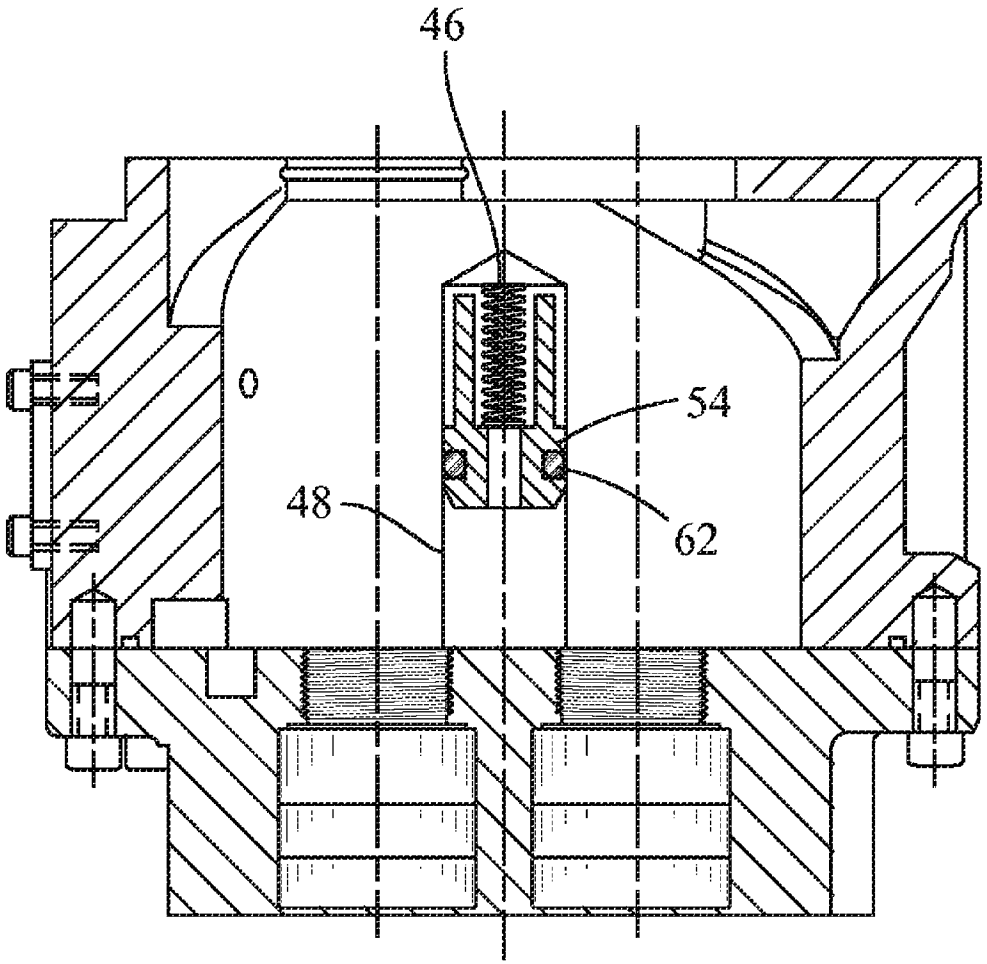
FIG. 4 depicts a cross-section view of a piston in the screw compressor of FIG. 2 and FIG. 3 retracted in a discharge port.

FIG. 4 provides another view of piston 54 positioned within discharge port 48. Referring to FIG. 4, in one embodiment, a partial horizontal cross-section view of screw compressor 38 through its center viewed from above is shown, providing a detailed view of discharge port 48. In FIG. 4, rotating screws 52 are not visible, as the view is taken below rotating screws 52. However, this view shows the path taken by compressed refrigerant gas 24 into discharge port 48. Piston 54 is secured within discharge port 48 using a spring 46 to bias piston 54 within discharge port 48, although any other deformable securing device or biasing means which selectively urges piston 54 to a position within discharge port 48 may be used. Piston 54 further includes at least one o-ring groove 62 for insertion of an o-ring. O-rings may be made of materials including, but not limited to, neoprene, chloroprene, other refrigerant fluid-resistant elastomeric compounds, or a combination thereof. Positioning an o-ring in o-ring groove 62 of piston 54 eliminates leakage of compressed refrigerant gas 24 around piston 54 within discharge port 48. Additionally, seals preventing leakage of compressed refrigerant gas 24 for use in combination with piston 54 include compression seals, mechanical seals, and the like. In FIG. 4, piston 54 is shown in a first position, fully retracted into discharge port 48. The first position of piston 54 provides discharge port 48 with a higher volume as compared to a second position of piston 54, shown in FIG. 5. This means that the pressure of fluid on the side of piston 54 opposite discharge port 48, assisted by fluid flow through proportional valve 56, is less than the force provided by biasing means, here spring 46, causing biasing means to move to a relaxed position while pulling piston to a position that provides a maximum volume to discharge port 48.

Figure 5:
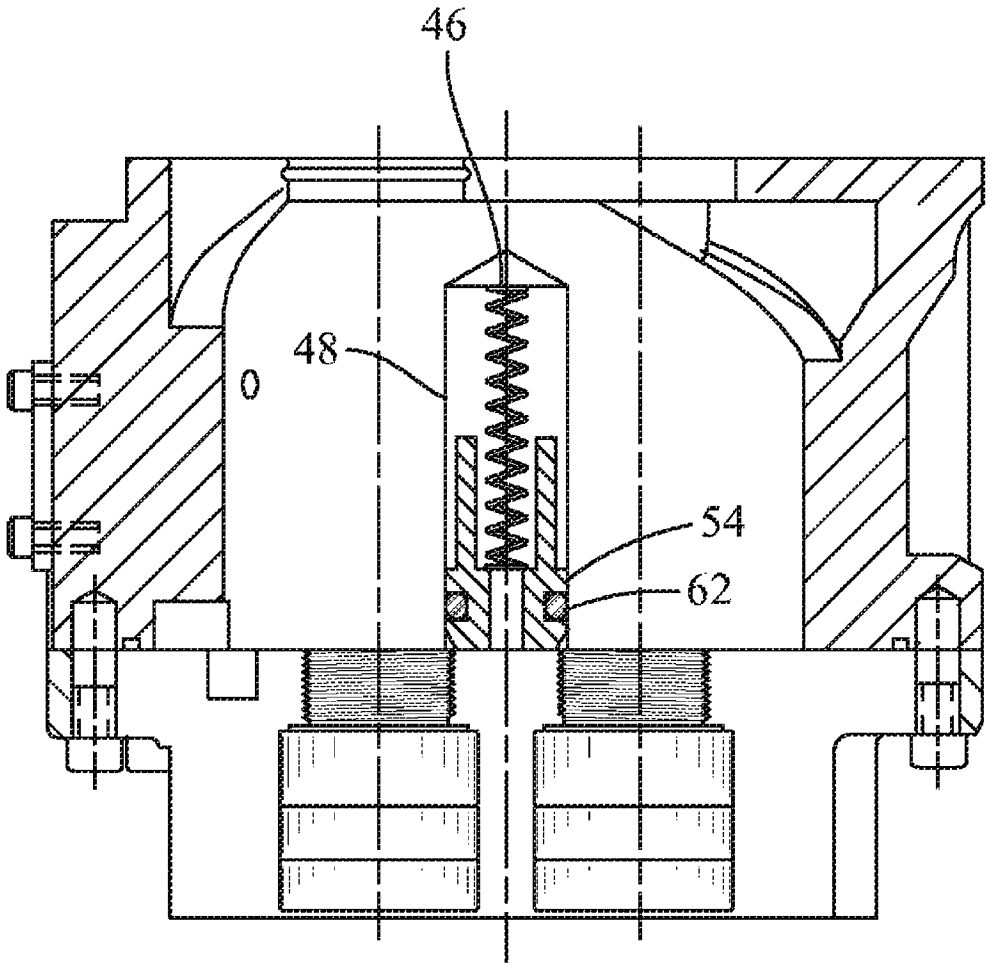
FIG. 5 depicts a cross-section view of a piston in the screw compressor of FIG. 2 and FIG. 3 extended in a discharge port.

FIG. 5 is a partial horizontal cross-section view of screw compressor 38 through its center viewed from above, providing a detailed view of discharge port 48. FIG. 5 is identical to FIG. 4, except that piston 54 is fully extended within discharge port 48 to a second position that minimizes the volume of the discharge port. In the second position, piston 54 covers apertures or by-pass holes 58, and discharge port 48 has a lower volume as compared to piston 54 in its first position, as shown in FIG. 4. Spring 46 is elongated as pressure behind piston 54 from proportional valve 56 increases, overcoming the force from biasing means, here spring 46 urging piston 54 to move within discharge port 48, downward in FIG. 5. Piston 54 is retracted by spring 46 upon decreasing and/or removing pressure from proportional valve 56, the spring urging the piston to return to the position depicted in FIG. 4 or to an intermediate position. The spring 46 or biasing means will provide a force that balances the pressure applied by fluid from proportional valve 56, so that any intermediate position of piston 54 within discharge port 48 can be achieved between the maximum volume position shown in FIG. 4 and the minimum volume position shown in FIG. 5 by controlling the fluid pressure applied to the piston through proportional valve 56.

FIG. 4 and FIG. 5 depict piston 54 in two extreme positions within discharge port 48, a first position in which the discharge port 48 has a higher volume (FIG. 4—maximum volume) and a second position in which the discharge port 48 has a lower volume (FIG. 5—minimum volume), respectively. It will be understood by those skilled in the art that piston 54 may be positioned within discharge port 48 at any position between the first position (maximum volume) depicted in FIG. 4 and the second position (minimum volume) depicted in FIG. 5 to provide a discharge port volume dependent on the location of piston 54 in port 48, the discharge port volume being variable with the position of the piston in the discharge port. Piston 54 generally may be fabricated of any suitable material for sealing by-pass holes 58, while also slidable within discharge port 48. The pressure fed from proportional valve 56 maintains piston 54 in a predetermined position, the predetermined position established by monitored parameters discussed below.

Figure 6:
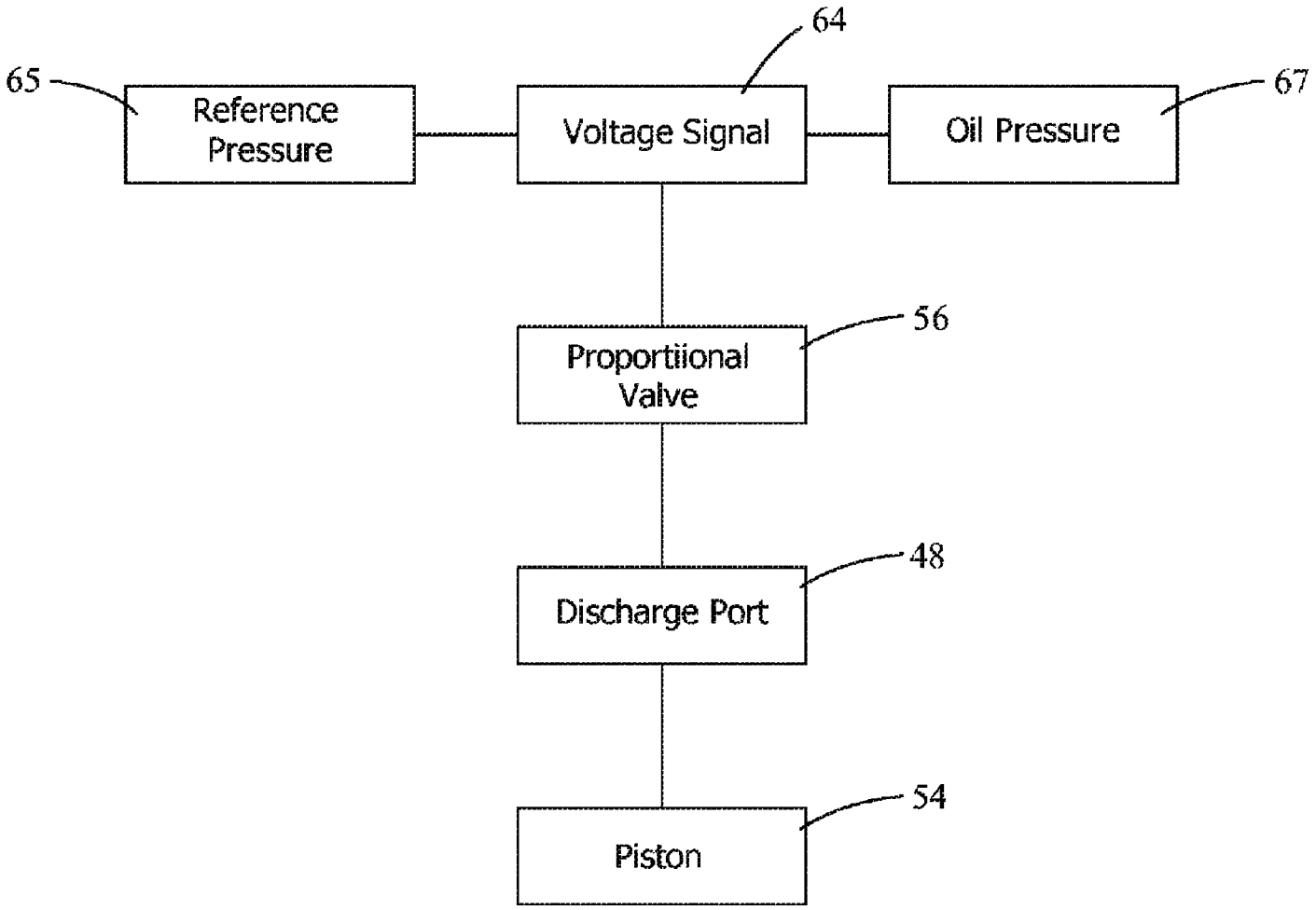
FIG. 6 schematically depicts a piston variation control process.

FIG. 6 depicts an exemplary control process 61. In control process 61, a value of a voltage signal 64 is adjusted based upon reference pressure 65 and oil pressure 67 monitored by a controller, such as may be located in control panel 22. Proportional valve 56 receives voltage signal 64 from control panel and adjusts pressure provided to discharge port 48 in response to the value of voltage signal 64. The pressure from proportional valve 56 in turn controls the position of piston 54 within discharge port 48 as discussed above.

Volume ratio $V_i$ is the ratio of a suction volume to a discharge volume and represents a measure of the efficiency of operation of screw compressor 38. The volume ratio is determined by a size and shape of discharge port 48. The volume associated with discharge port 48 is referred to as a discharge port volume. The suction volume is a volume within the helical-grooves of rotating screws 52 before compression. In one embodiment, the pair of rotating screws 52 has male helical-grooves and female helical-grooves. The male helical-grooves mesh with the female helical-grooves to compress refrigerant 28. The discharge volume is a volume of rotating screws 52 meshing just prior to an opening to discharge port 48. More specifically, the volume ratio is provided as: $V_i = \epsilon^{1/\kappa}$, where $V_i$ is the volume ratio, $\epsilon$ is compression ratio, and $\kappa$ is a refrigerant constant. For refrigerant 134A, $\kappa$ is 1.18.

Referring to FIG. 4, in one embodiment, piston 54 in the first position provides discharge port 48 with the higher volume as compared to piston 54 in the second position. Compressed refrigerant gas 24 from the screws is discharged into discharge port 48 with the higher volume achieves a decreased volume ratio, since for a fixed suction volume, an increase in discharge volume results in a smaller volume ratio. The decreased volume ratio increases efficiency of screw compressor 38 and refrigeration system 21 during periods of decreased demand, such as when ambient temperature is low, such as during winter months and/or during maintenance periods. As used herein, ambient temperature refers to an environmental temperature at a time of measurement. Thus, screw compressor efficiency is improved during periods of decreased demand be increasing the volume of the discharge port, which decreases the volume ratio.

Referring to FIG. 5, in one embodiment, piston 54 in the second position provides discharge port 48 with the lower volume as compared to piston 54 in the first position of FIG. 4. Compressed refrigerant gas 24 discharged into discharge port 48 with the lower volume provides an increased or higher volume ratio. The increased volume ratio increases efficiency of screw compressor 38 and refrigeration system 21 during periods of increased demand, such as during a start-up and/or when the ambient temperature is high, such as during summer months. Thus, screw compressor efficiency is improved during periods of increased demand be decreasing the volume of the discharge port, which increases the volume ratio.

It will also be recognized by those skilled in the art that the volume ratio $V_i$ may be adjusted, if desired, to intermediate positions between the extremes shown in FIGS. 4 and 5 during periods of intermediate demand. An intermediate adjustment is desirable for conditions between higher demand and lower demand, such as during conditions that may occur during spring and autumn. To increase efficiency of refrigeration system 21 throughout various operating conditions, a continuously variable volume ratio $V_i$ is desirable.

In one embodiment, a higher volume ratio $V_i$ is desired for higher ambient temperatures. The ambient temperature is the current or present environmental temperature of a geographical region during a season. Higher operating pressures are desirable under higher ambient temperatures, such as may occur during summer months as well as late spring or early autumn, and the lower volume of discharge port 48, produced by piston 54 biased toward the second position (FIG. 5), provides such higher pressures. A higher pressure of compressed refrigerant gas 24 at discharge port 48 increases a downstream pressure at evaporator 27, which in turn increases cooling capacity of the system. An increase in compressed refrigerant gas pressure represents an increase in work performed by screw compressor 38. The increase in work represents an increase in energy usage by screw compressor 38, but screw compressor 38 is operated in a more efficient manner at higher pressure when demand is high.

In one embodiment, a lower volume ratio $V_i$ is desired for lower ambient temperatures such as may occur during the winter season or during early spring and late fall. Lower ambient temperatures permit lower operating pressures, and the larger volume of discharge port 48, produced by piston 54 biased toward the first position (FIG. 4), provides lower pressures. A lower pressure of compressed refrigerant gas 24 at discharge port 48 decreases the downstream pressure at evaporator 27, which in turn decreases the cooling capacity of the system, desirable when the ambient is cooler. In one embodiment, the reduction in pressure represents a decrease in work performed by screw compressor 38, which results in improved screw compressor efficiency at lower ambient temperature conditions. In one embodiment, by matching the volume ratio $V_i$ to the current demand on refrigeration system 21, screw compressor 38 is operated more efficiently, and noise from screw compressor 38 operations is also reduced.

In one embodiment, voltage signal 64 is varied in value based upon reference pressure 65 and/or oil pressure 67. Reference pressure 65 includes, but is not limited to, head pressure, condenser pressure, volume ratio, or a combination thereof. Changes in oil pressure 67 follow changes in discharge pressure. As reference pressure 65 and/or oil pressure 67 increase or decrease, the value of voltage signal 64 is adjusted accordingly. In response to adjustments in the value of voltage signal 64, proportional valve 56 increases or decreases pressure to discharge port 48. As demand changes, the adjustments in pressure from proportional valve 56 to discharge port 48 move piston 54, which adjusts the discharge port volume to increase efficiency. The position of piston 54 within discharge port 48 is determined by any convenient method.

The proportional valve 56 may be in communication with a controller located at or in communication with control panel 22, which also monitors a reference pressure such as oil pressure, head pressure, condenser pressure or a combination thereof. Controller may also monitor ambient temperature, temperature of the space being cooled or other relevant measurable parameter of the refrigeration or cooling system, as are well known to those skilled in the art. The controller may then generate a voltage signal based on one or more of the values monitored, which signal is provided to proportional valve 56 to vary the position of piston 54 within discharge port 48. The controller may generate the voltage based on an algorithm that includes one or more of these monitored values or it may generate the voltage based on a predetermined table, the controller using the table to determine the desired voltage value based on the values of the monitored conditions, and providing the voltage to proportional valve 56 move piston 54 in response to the monitored conditions.

By using discharge port 48 with piston 54 to provide a variable discharge volume, screw compressor 38 may be fabricated for uninterrupted use and increased efficiency in any climate. The volume ratio $V_i$ of screw compressor 38 can be adjusted by continually monitoring operational or environmental conditions, or both, without stopping or disassembling screw compressor 38, thereby providing increased efficiency of refrigeration system 21. Additionally, screw compressor 38 having a continuously variable volume ratio $V_i$ can be continuously adjusted during operation to match demand on refrigeration system 21, providing increased efficiency.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A positive displacement, variable-efficiency screw compressor, comprising:

an inlet port drawing refrigerant gas into the screw compressor at a suction volume;

at least one rotating screw in fluid communication with the inlet port to compress the refrigerant gas;

a discharge port in fluid communication with the at least one rotating screw to receive and discharge the compressed refrigerant gas at a discharge volume;

a piston positioned within the discharge port, the piston movable from a first position in which the discharge volume of the discharge port is extended to a second position in which the discharge volume of the discharge port is contracted, and to intermediate positions, at which the discharge volume of the discharge port is intermediate between the extended discharge volume and the contracted discharge volume;

wherein the piston is arranged and disposed within the discharge port, adjusting discharge volume of the discharge port and a volume ratio of the suction volume to the discharge volume in response to a change in system volume ratio;

a biasing member attached to a first side of the piston; and a proportional valve in fluid communication with the discharge port on the first side of the piston, wherein the proportional valve is configured to supply fluid pressure to the piston to counter balance the biasing force from the biasing member, and wherein the proportional valve is configured to adjust the fluid pressure applied to the piston based at least on an operating parameter of the compressor to move the piston within the discharge port and provide the discharge port with a predetermined discharge volume.

2. The screw compressor of claim 1 wherein the biasing member is a spring attached to the piston on a side of the piston opposite discharge of refrigerant gas from the at least one rotating screw.

3. The screw compressor of claim 1 wherein the operating parameter of the compressor includes at least one of a reference refrigerant pressure and a reference oil pressure.

4. The screw compressor of claim 1, wherein the suction volume is substantially constant during operation of the compressor.

5. A variable-efficiency refrigeration system, comprising a positive displacement compressor having a working volume and at least one screw for compressing a refrigerant gas;

a power source powering the compressor;

a control panel modulating the power source;

a condenser in fluid communication with the compressor condensing the compressed refrigerant gas to a compressed liquid;

an evaporator in fluid communication with the condenser and with the compressor;

an expansion valve positioned between the condenser and the evaporator, the expansion valve receiving compressed refrigerant liquid and expanding the compressed refrigerant liquid, forming a mist of gas and liquid; and wherein the compressor is a variable-efficiency screw compressor, further comprising:

an inlet port drawing refrigerant gas into the screw compressor at a suction volume;

at least one rotating screw in fluid communication with the inlet port to compress the refrigerant gas;

a discharge port in fluid communication with the at least one rotating screw to receive and discharge the compressed refrigerant gas at a discharge volume;

a piston positioned within the discharge port, the piston movable from a first position in which the discharge volume of the discharge port is extended to a second position in which the discharge volume of the discharge port is contracted, and to intermediate positions, at which the discharge volume of the discharge port is intermediate between the extended discharge volume and the contracted discharge volume;

wherein the piston is arranged and disposed within the discharge port, adjusting discharge volume of the discharge port and a volume ratio of the suction volume to the discharge volume in response to a change in system volume ratio;

a biasing member attached to a first side of the piston; and a proportional valve in fluid communication with the discharge port on the first side of the piston, wherein the proportional valve is configured to supply fluid pressure to the piston to counter balance the biasing force from the biasing member, and wherein the proportional valve is configured to adjust the fluid pressure applied to the piston based at least on an operating parameter of the compressor to move the piston within the discharge port and provide the discharge port with a predetermined discharge volume.

6. The refrigeration system of claim 5, further including water in heat exchange communication with the evaporator, the water being cooled by the evaporator and provided to a chiller wherein the chilled water from the chiller can be used to cool a remote area.

7. The refrigeration system of claim 5, further including a heat transfer medium in heat exchange communication with the evaporator, wherein the heat transfer medium cooled by the evaporator, cools an immediate area.

8. The refrigeration system of claim 5, wherein the refrigeration system is a closed loop system.

9. The refrigeration system of claim 5, wherein the suction volume is substantially constant during operation of the compressor.

10. A variable-efficiency screw compressor system, comprising:

an inlet port to draw refrigerant into the variable-efficiency screw compressor at a suction volume;

one or more rotating screws in fluid communication with the inlet port to compress the refrigerant, forming a compressed refrigerant;

a discharge port in fluid communication with the rotating screws to receive the compressed refrigerant and discharge the refrigerant at a discharge volume;

wherein the discharge port includes an adjustable piston movable to any position between a first position and a second position to provide an intermediate volume to adjust the discharge volume and a volume ratio of the suction volume to the discharge volume in response to a change in system volume ratio;

a proportional valve in fluid communication with the discharge port on a first side of the piston attached to the biasing member, wherein the proportional valve is configured to supply fluid pressure to the piston to counter balance the biasing force from the biasing member, and wherein the proportional valve is configured to adjust the fluid pressure applied to the piston based at least on an operating parameter of the compressor to move the piston within the discharge port and provide the discharge port with a predetermined discharge volume.

11. The screw compressor system of claim 10, wherein efficiency of the compressor is substantially determined by the position of the adjustable piston in the discharge port.

12. The screw compressor system of claim 10, wherein the volume ratio is adjustable to increase efficiency based on environmental temperatures of a geographic area in which the variable-efficiency screw compressor will be used.

13. The screw compressor system of claim 10, wherein the suction volume is substantially constant during operation of the screw compressor system.

14. A method for adjusting a volume ratio of a screw compressor in response to a change in system volume ratio, comprising the steps of:

providing a screw compressor, the screw compressor including:

an inlet port drawing refrigerant gas into the screw compressor at a suction volume, at least one rotating screw in fluid communication with the inlet port to compress the refrigerant gas, a discharge port in fluid communication with the at least one rotating screw to receive and discharge the compressed refrigerant gas at a discharge volume, a piston positioned within the discharge port, the piston movable from a first position in which the discharge volume of the discharge port is extended to a second position in which the discharge volume of the discharge port is contracted, and to intermediate positions, at which the discharge volume of the discharge port is intermediate between the extended discharge volume and the contracted discharge volume, wherein the piston is arranged and disposed within the discharge port, adjusting the discharge volume of the discharge port and the volume ratio of the suction volume to the discharge volume in response to a change in system volume ratio, and a spring attached to a first side of the piston; and monitoring at least one condition of the compressor indicative of a change in system volume ratio;

providing a proportional valve in fluid communication with the discharge port on the first side of the piston;

applying fluid pressure to the piston to counter balance the spring force from the spring; and adjusting a position of the piston by adjusting the fluid pressure supplied by the proportional valve to the piston based on the at least one condition of the compressor to move the piston within the discharge port and provide the discharge port with a predetermined volume.

15. The method of claim 14, comprising maintaining the suction volume at a substantially constant volume.

* * * * *